United States Patent [19]

Kevorkian et al.

[11] 4,106,997

[45] Aug. 15, 1978

[54] METHODS FOR CONVERTING COAL TO A PLASTIC-LIKE CONDITION AND FEEDING SAME TO A RECEIVER

[75] Inventors: Victor Kevorkian, Belle Mead, N.J.; Francis J. Cumings, Windham, N.H.

[73] Assignee: Ingersoll-Rand Research, Inc., Princeton, N.J.

[21] Appl. No.: 787,087

[22] Filed: Apr. 13, 1977

Related U.S. Application Data

[63] Continuation of Ser. No. 698,170, Jun. 21, 1976, abandoned, which is a continuation of Ser. No. 529,037, Dec. 3, 1974, Pat. No. 3,976,548.

[51] Int. Cl.[2] ..... C10B 47/20; C10B 47/44

[52] U.S. Cl. ..... 201/32; 201/6; 201/35; 202/118; 48/86 A; 44/11

[58] Field of Search ..... 201/32, 201/5, 6, 35; 202/118; 48/86 R, 86 A; 44/11, 12

[56] References Cited

U.S. PATENT DOCUMENTS

| | | | |
|---|---|---|---|
| 1,723,932 | 8/1929 | Greene et al. | 202/118 |
| 1,771,999 | 8/1930 | Greene et al. | 202/118 X |
| 2,088,679 | 8/1937 | Yamazaki et al. | 48/86 R |

*Primary Examiner*—James H. Tayman, Jr.
*Attorney, Agent, or Firm*—Bernard J. Murphy

[57] ABSTRACT

The invention comprises methods for converting a supply of solid, naturally occurring coal and like hydrocarbon material to a plastic-like condition solely by the application of heat, and without employing any extraneous additives, and conducting the plastic-like conditioned material to a pressurized receiver.

6 Claims, 2 Drawing Figures

Figure 1:
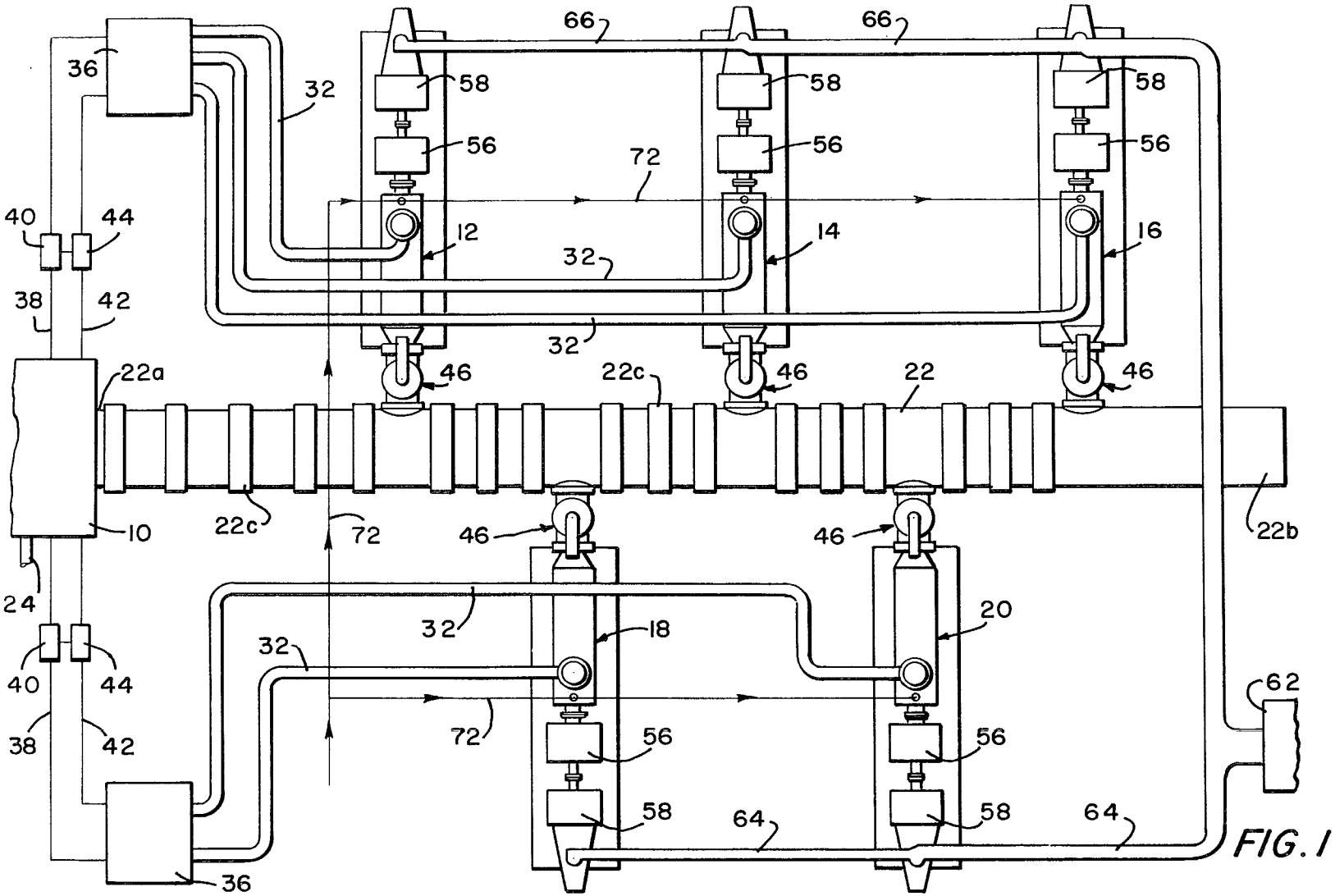

METHODS FOR CONVERTING COAL TO A PLASTIC-LIKE CONDITION AND FEEDING SAME TO A RECEIVER

This is a continuation of application Ser. No. 698,170, filed June 21, 1976, which is now abandoned, and which was a continuation of application Ser. No. 529,037, filed Dec. 3, 1974 which issued as U.S. Pat. No. 3,976,548 on Aug. 24, 1976.

The present invention relates to the processing of coal and like material and more particularly to the provision of new and improved methods particularly adapted for the conversion of coal and like material. As will be understood, the term "coal and like material" is employed herein to include coal, coke, coal tar, asphalt, bitumen, kerogen, and mixtures thereof, all of the mentioned materials being hydrocarbon materials in solid state at room temperature and naturally occuring or readily derivable from naturally occurring materials by simple physical processes.

Currently, processes are being developed for the gasification and liquification of coal. These processes, however, operate at elevated temperatures and pressures of, for example, 50 to 1,500 PSIG, thereby complicating the feeding of the coal into the pressurized reaction vessel. It has been proposed that coal be fed into such reaction vessels either in solid form by the employment of lock hoppers or, alternatively, in liquid slurry by pumps. However, large, high pressure lock hoppers are cumbersome, undesirably expensive, and do not provide the continuous feed of the coal which is often required. Feeding of the coal in liquid slurry is inefficient and undesirable as the liquid component of the slurry must be vaporized within the reaction vessel.

An object of the present invention is to provide new and improved methods for the conversion of coal and like material, which are particularly adapted for feeding the material to a pressurized receiver such as, for example, a pressurized reaction vessel.

Another object is to provide new and improved methods which are particularly adapted whereby the coal and like material may be converted to plastic-like condition solely by the application of heat and without the necessity for any additives.

Other objects and advantages of the invention will be apparent from the following description taken in connection with the accompanying drawings wherein, as will be understood, the preferred forms of the invention have been shown for the purposes of illustration only.

In accordance with the invention, coal and like material may be converted to a plastic-like condition by a method comprising the steps of providing a supply of the material in a solid, naturally occurring state; providing a rotatively driven screw means having an inlet opening and a discharge opening; providing a receiver which is pressurized substantially in excess of atmospheric pressure; communicating said discharge opening with said pressurized receiver; feeding the supplied material to said inlet opening of said screw means, to cause said means to move the material to said discharge opening for discharge thereof to said pressurized receiver; and only heating the material, during movement thereof by said screw means, to a given temperature which is sufficiently great to effect conversion of the material to said plastic-like condition; and further including the step of preheating the material, prior to said feeding step, to a temperature less than said given temperature.

Figure 2:
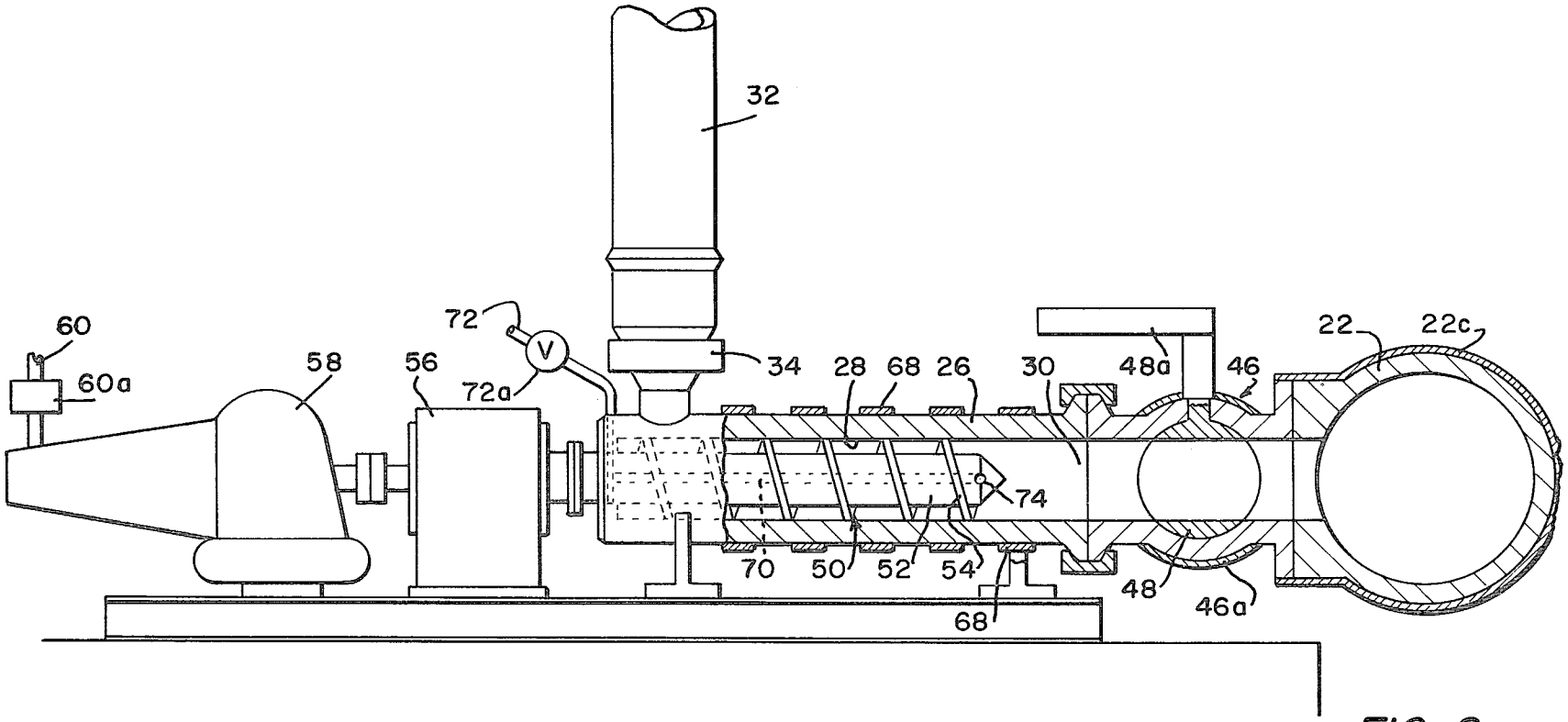

Referring to the drawings:

FIG. 1 is a top or plan view schematically depicting an installation including a plurality of apparatuses capable of practicing the invention arranged for feeding a pressurized receiver in the form of a coal gasification reactor; and FIG. 2 is an enlarged, elevational view, partially broken away and in section, of one of the feeding apparatuses included in the installation shown in FIG. 1.

Referring more particularly to the drawings wherein similar reference characters designate corresponding parts throughout the several views, FIG. 1 illustrates an installation comprising a pressurized receiver in the form of a coal gasification reactor 10, having therein a pressure which may be from 300 to 1,500 PSIG, arranged to receive coal from a plurality of feeding apparatuses or units 12,14,16,18,20 which could be, as desired, either horizontal or vertical. The feeding apparatuses 12,14,16,18,20 are all of identical construction and, as shown, individually connected in parallel to a coal manifold supply conduit 22, which is, in turn, at one end 22*a* connected to the reactor 10 to supply coal to the reactor 10. As will be understood, although the end 22*a* of the manifold supply conduit 22 has been shown as being directly connected to the reactor 10, this has been done for the purposes of illustration only and normally the end 22*a* of the conduit 22 would be connected to the reactor 10 through suitable conventional intermediate piping such as lift lines (not shown). The other or opposite end 22*b* of the manifold supply conduit 22 is connected to the reactor 10 through piping 24 to receive gas from the reactor 10 whereby such gas flows through the conduit 22 for driving coal through the latter and into the reactor 10. The manifold supply conduit 22 is circumferentially provided with heaters 22*c* throughout the portion of its length intermediate its end 22*a* and its connection to the feeding apparatus 16 which is the most remote from such end 22*a*. One of the feeding apparatuses 12,14,16,18,20 could be a standby or reserve unit normally held out of service, and operated only when the others thereof are shut down one-by-one for routine maintenance. In this manner, continuous feeding of coal to the reactor 10 can be insured at all times, even during the maintenance of the ones of apparatuses 12,14,16,18,20 normally in service. Also, if desired, the feeding apparatuses 12,14,16,18,20 could be individually directly connected to the reactor 10 rather than, as illustrated, connected to such reactor 10 through a manifold supply conduit 22.

FIG. 2 illustrates the details of construction of the feeding apparatus 20 and its associated devices, it being understood however that, as the apparatuses 12,14,16,18,20 are all of identical construction, the hereinafter given description of the apparatus 20 and its associated devices is equally applicable to all of the others thereof. As shown in FIG. 2, the apparatus 20 comprises a barrel or housing 26 containing a circular cross-section bore 28 and at one end having a discharge opening 30 connecting the corresponding end of the bore 28 with the manifold 22 for supplying coal to the manifold 22. Adjacent to its other end, the barrel 26 is connected to a coal feed conduit 32 which communicates with the there-adjacent end of the bore 28 for supplying coal to the latter. The coal feed conduit 32 contains a shut-off valve 34 and, as shown in FIG. 1, is connected to a source 36 of dry solid coal which may be in either granular or lump form. The coal source 36 communicates with the reactor 10 through a gas supply conduit 38, containing an expander 40 for reducing the pressure of the gas, to receive gas exhausted from the reactor 10 and also communicates with the reactor 10 through a gas return conduit 42, containing a compressor 44 for increasing the gas pressure, whereby the gas is returned to the reactor 10. Hence, coal in the source 36 is resultantly heated prior to its supply to the apparatus 20, the extent of such pre-heating of the coal being readily controllable by control of the temperature of the gas supplied into the source 36 through the gas supply conduit 38; and, as will be understood, the temperature to which the coal is so heated in the source 36 is maintained lower than the temperature necessary for conversion of the solid coal into plasticized or plastic-like condition. Each of the apparatuses 12,14,16,18,20 may be fed from a separate source 36 or, alternatively, a single such source 36 may be employed for feeding a plurality of such apparatuses. This latter arrangement is shown in FIG. 1 wherein, as will be noted, one source 36 is employed for supplying coal to the apparatuses 18,20 while a second such source 36 is similarly connected for supplying coal to the apparatuses 12,14,16.

The apparatus 20 further comprises a shut-off valve, designated generally as 46 and circumferentially provided with heater means **46*a*, which is interposed intermediate the discharge opening 30 and the coal manifold supply conduit 22. The shut-off valve 46 includes a valving element 48 shown as manually operated by an operating handle 48*a* to alternatively permit and prevent flow from the discharge opening 30 to the manifold 22, it being understood that the valving element 48 could be, if desired, remote control operated by any suitable conventional control system. The valving element 48 of the valve 46 for each apparatus 12,14,16,18,20 is normally maintained open throughout the feeding of coal by the apparatus to the manifold 22** and closed only when the apparatus is shut-down from such operation.

A feed screw 50, comprising a body 52 having a helical flight or thread 54 therearound, is rotatably disposed coaxially within the bore 28 for longitudinally feeding coal through the bore 28 to the discharge opening 30. The screw 52 is connected to a conventional speed reducer 56, in turn, connected to a driving means shown as being a turbine driver 58, whereby the screw 54 is rotatably driven without axial screw movement by the driver 58 through the speed reducer 56. The turbine driver 58 is connected to a suitable source of motive steam by a steam supply conduit 60, containing a shut-off valve **60*a*, the conduits 60 for all of the apparatuses 12,14,16,18,20 being shown in FIG. 1 as connected to receive steam from a source 62 through steam supply conduits 64,66. The barrel 26 is provided with circumferential heating coils 68 arranged to, together with heat generated by shear due to rotation of screw 50, assist in heating coal within the bore 28 to a temperature sufficiently great to effect conversion of such coal from the solid state to plastic-like condition, it being understood that, if desired, a superheated steam jacket (not shown) could be provided around the barrel 26 in place of the illustrated coils 28 for this purpose. The screw 50 contains an axial bore 70 communicating through transverse bores in the screw 50 and barrel 26 with a steam supply conduit 72, containing a shut-off valve 72*a*, which is in turn connected to a superheated steam source (not shown), whereby steam continuously passes internally of the screw 50 for assisting in such heating of the coal in the bore 28. The end of the screw 50 most adjacent to the discharge opening 30 includes one or more openings 74 communicating with the screw contained bore 70 for discharging steam from the latter into the barrel contained bore 28**, for purposes to be hereinafter described.

Throughout the operation of the beforedescribed installation, four of the apparatuses 12,14,16,18,20 may be continously operated to feed coal to the manifold 22, while the fifth apparatus is maintained on standby and out of operation. The screws 50 of the operating apparatuses 12,14,16,18,20 are continuously rotatably driven by their respective turbine drivers 58, with their corresponding shut-off valves 46 open. Dry coal, either in granular or lump form dependent on the size of the bores 28 and their contained screws 50, is pre-heated in the coal sources 36 to a temperature below the temperature at which it is converted into plasticized or plastic-like condition and then supplied in solid state from the sources 36 through the conduits 32 into the bores 28 of the operating apparatuses. The thus supplied coal is further heated in such bores 28 to a temperature (for example, at least in the range of 750° to 800° F) at which the coal becomes converted to plastic like condition solely by heating as it is driven around the screws 52 towards the discharge openings 30, while such coal packs around the screws 50 to effectively seal therearound. During this conversion of the coal to plastic-like condition, the temperature of the coal is, as will be understood, maintained substantially lower than the temperature in the reactor 10, and volatiles in the coal are driven off with the driven off liquid volatiles condensing and the driven off gaseous volatiles passing into the manifold conduit 22. The screws 50 pump the coal in plastic-like condition through the discharge openings 30 and into the coal supply manifold conduit 22; and such coal is broken up into small size prior to its said discharge into the conduit 22 by the superheated steam passing outwardly from the screw contained bore 70 through the bores 74. The coal is thus supplied to the manifold supply conduit 22 and thence driven through the conduit 22 and into the reactor 10 by the gas supplied into the end **22*b* of the conduit 22 from the reactor 10**.

From the preceding description, it will be seen that the invention provides new and improved process steps for accomplishing all of the beforestated objects and advantages. It will be seen that coal and like material may be converted from solid state to plastic-like or plasticized condition solely by heat and without the necessity that any additive be added to the material. It will be understood that, as desired the barrel and/or the screw of the apparatus could be provided with heating means for effecting such conversion; and also that reactor gas, rather than steam, could be used for so heating the material. Moreover, although coal has been hereinbefore specifically described as being the material being processed in the illustrated embodiment of the invention, the application of the invention is not limited to coal, but rather encompasses any of the materials beforedescribed as included in the term "coal and like materials."

In addition, it will be further understood that, although appparatus capable of practicing the novel methods has been illustrated as arranged for feeding a coal gasification reactor, the application of only such apparatus to the practice of the invention is not so limited, and, for example, further embodiments of apparatus capable of practicing the invention could be employed for feeding pressurized vessels other than a coal gasification reactor. By way of illustration, further embodiments of apparatus capable of practicing the invention could be used for feeding material to synthesis gas generators for coal liquification plants, wherein the pressure is in the range of 50 to 1,500 PSIG, and/or for feeding material to partial oxidation processes wherein the employed pressure is in the range of 300 to 1,500 PSIG. Also, embodiments of such apparatus need not include the disclosed plurality of units as such plurality has been shown only for the purposes of illustration of a preferred form of an invention-practicable apparatus.

From the preceding description it will be seen that the invention provides new and improved methods for accomplishing all of the beforestated objects and advantages. It will be understood, however, that although only a single embodiment of an apparatus capable of practicing the process steps of the invention has been illustrated and hereinbefore specifically described, the invention is not limited merely to practice thereof with this single embodiment, but rather contemplates other embodiments and variations within the scope of the following claims.

Having thus described our invention, we claim:

1. A method for converting coal to a plastic-like condition and feeding such converted coal to a pressurized receiver, comprising the steps of:

providing a supply of coal;

providing a housing with a rotatively driven screw means therewithin, said housing having an inlet opening and a discharge opening;

providing a pressurized receiver;

communicating said discharge opening with said pressurized receiver;

feeding the supplied coal to said inlet opening of said housing, to cause said screw means therewithin to move the coal through said housing to said discharge opening for discharge thereof to said pressurized receiver;

heating the coal, during movement thereof through said housing by said screw means, to a given temperature, of at least about 750° to 800° F, which is sufficiently great to effect conversion of the coal to said plastic-like condition; wherein said step of heating the coal to a given temperature, during movement thereof through said housing by said screw means, comprises conducting a continuous flow of hot, energized, fluid through said screw means to heat said screw means, and to cause the latter to heat the coal; and further comprising the step of breaking up the converted coal, prior to discharge thereof from said housing to said receiver, by venting said continuous flow of energized fluid from openings in a terminal end of said screw means and addressing the venting fluid to the converted coal which has been moved through the housing to the discharge opening thereof.

2. A method for converting and feeding coal and like material according to claim 1, wherein said receiver providing step comprises providing a receiver having a pressure of at least about 50 PSIG.

3. A method for converting and feeding coal and like material according to claim 1, wherein the material supply providing step comprises providing said material in granular form.

4. A method for converting and feeding coal and like material according to claim 1, wherein the material supply providing step comprises providing said material in lump form.

5. A method for converting and feeding coal and like material according to claim 1, wherein said receiver providing step comprises providing a coal gasification reactor.

6. A method for converting and feeding coal and like material according to claim 1, wherein said receiver providing step comprises providing a synthesis gas generator.

* * * * *